US006875565B2

(12) United States Patent
Ceruti et al.

(10) Patent No.: US 6,875,565 B2
(45) Date of Patent: Apr. 5, 2005

(54) SILVER HALIDE PHOTOGRAPHIC EMULSION AND PHOTOGRAPHIC ELEMENT COMPRISING IT

(75) Inventors: Luca Ceruti, Savona (IT); Simona Fava, Genoa (IT)

(73) Assignee: Ferrania, S.p.A., Savona (IT)

( * ) Notice: Subject to any disclaimer, the term of this patent is extended or adjusted under 35 U.S.C. 154(b) by 0 days.

(21) Appl. No.: 10/696,873

(22) Filed: Oct. 30, 2003

(65) Prior Publication Data

US 2004/0086814 A1 May 6, 2004

(30) Foreign Application Priority Data

Oct. 31, 2002 (IT) ..... SV2002A0054

(51) Int. Cl.[7] ..... G03C 1/005; G03C 1/494

(52) U.S. Cl. ..... 430/567; 430/631; 430/627; 430/642; 430/628; 430/634; 430/639

(58) Field of Search ..... 430/567, 631, 430/642, 627, 628, 634, 639

(56) References Cited

U.S. PATENT DOCUMENTS

| | | | | |
|---|---|---|---|---|
| 3,637,389 A | | 1/1972 | Hofman | 96/66 |
| 5,302,505 A | | 4/1994 | Delfino et al. | 430/567 |
| 5,370,986 A | | 12/1994 | Lok et al. | 430/607 |
| 5,374,509 A | | 12/1994 | Valentini | 430/536 |
| 5,529,892 A | | 6/1996 | Massirio et al. | 430/523 |
| 6,235,461 B1 | * | 5/2001 | Sismondi et al. | 430/569 |
| 6,664,038 B2 | * | 12/2003 | Ceruti et al. | 430/642 |

FOREIGN PATENT DOCUMENTS

| | | | |
|---|---|---|---|
| EP | 0936201 A2 | 8/1999 | G04B/24/10 |
| EP | 0950697 A1 | 10/1999 | C09D/17/00 |
| EP | 0965880 A1 | 12/1999 | G03C/1/04 |
| EP | 1300724 A1 | 4/2003 | G03C/1/04 |
| JP | 55098745 | 7/1980 | G03C/1/74 |
| JP | 55098746 | 7/1980 | G03C/1/74 |
| JP | 08122956 | 5/1996 | G03C/1/08 |
| WO | WO 95/02614 | 1/1995 | C08B/37/00 |

OTHER PUBLICATIONS

"Photographic Silver Halide Emulsions, Preparations, Addenda, Systems and Processing," Research Disclosure No. 38597, Sep. 1996, Item IX.

* cited by examiner

*Primary Examiner*—Geraldine Letscher
(74) *Attorney, Agent, or Firm*—Mark A. Litman & Associates, P.A.

(57) ABSTRACT

A silver halide emulsion which comprises silver halide tabular grains showing an average thickness lower than 0.15 μm, an average diameter of at least 1.20 μm and an average aspect ratio of at least 8:1 dispersed in a hydrophilic colloid mixture comprising from 10% to 30% by weight of dextran, from 20% to 40% by weight of a hydrogenated polysaccharide having an average molecular weight equal to or lower than 10,000, and from 40% to 60% by weight of gelatin and photographic element comprising it.

16 Claims, No Drawings

SILVER HALIDE PHOTOGRAPHIC EMULSION AND PHOTOGRAPHIC ELEMENT COMPRISING IT

BACKGROUND OF THE INVENTION

1. Field of the Invention

The present invention relates to a silver halide photographic emulsion and to a silver halide photographic element. More particularly, the present invention relates to a silver halide photographic emulsion for use in a radiographic element having improved sensitometric results and covering power.

2. Background of the Art

In recent years, there has been a strong demand for high sensitivity, low graininess and low fog in silver halide photographic elements as well as for rapid processing in which development is accellerated. Recently, demand for photographic performance of silver halide photographic light sensitive materials has become more severe. In particular, demands for not only basic performance such as high sensitivity, low fog and superior graininess but also other performance such as rapid processing, mechanical resistance and storage stability become stronger than those demands in the past.

In general, silver halide photographic light sensitive materials are subject to a variety of mechanical stresses. A photographic film is subject to mechanical stresses in the manufacturing process thereof, or is bent or abraded when being transported in the automatic processor. As well known in the art, when mechanical stresses are applied to the silver halide photographic material, changes in photographic performance are produced, and a technique for enhancing resistance to these mechanical stresses has been desired. The silver halide emulsions presently employed in photographic elements are more sensitive to mechanical stresses during automatic processing. There is the need to provide a photographic element having increased mechanical resistance without negatively affecting the underlying sensitometric properties.

Several approaches have been attempted to solve this problem. Hardening of emulsion layers has been the more general approach described in a number of patents and patent applications, such as, for example, in U.S. Pat. Nos. 5,529,892 and 5,302,505. Another approach relates to the introduction of an intermediate gelatin layer interposed between the support and the emulsion layer, as described, for example, in U.S. Pat. No. 3,637,389.

Still another approach relates to the introduction of coating additives. For example, methods in which polymer latexes or plasticizers are included, methods in which the silver halide/gelatin ratio in the silver halide emulsion layer is reduced, and methods in which a lubricant or colloidal silica is added to the protective layer, are well known as means of improving the mechanical resistance of photographic elements. A description of useful coating additives can be found in Research Disclosure No. 38597, September 1996, "Photographic Silver Halide Emulsions, Preparations, Addenda, Systems and Processing", Item IX.

U.S. Pat. No. 5,374,509 describes a mixture of hydrophilic colloid, a branched polysaccharide, a polyacrylamide, a polyvinylidine chloride and a polyacrylate in a binder.

JP 08-0122956 describes a silver halide emulsion which contains a metal chelating agent (type tartaric acids, ethylene diamine tetraacetates, nitro triacetates, uramil diacetates) and a mono-, di- or poly-saccharide.

JP 55-098745, JP 55-098746, describes polysaccharides having glucose units as main chain and mannose, fucose and glucoronic acids as side chain in photographic solution preparation for high speed coating and improved physical properties.

U.S. Pat. No. 5,370,986 describes the use of polyhydroxyalkyl stabilizer compounds and a co-stabilizing agent in silver chloride photographic element to prevent fog formation. The polyhydroxyalkyl stabiliser is a non-reducing oligosaccharide or its alkyl-substituted glycoside of formula $R—(CHOH)_n(CHOR_1)_m—Z$ with n=3–7, m=0–7, $R=R_1=H$ or 1–3C alkyl, Z=COOR' or CONR'R' and R'=1–3C alkyl.

WO 95-02614, EP 950,697, and EP 936,201 describe the preparation and use of hydrogenated polysaccharides for the preparation of mixtures with mineral binders, fillers and/or pigments.

EP 965,880 describes the use of hydrogenated polysaccharides in combination with an aryl compound having at least two hydroxyl groups to increase the speed to Dmin ratio of a light-sensitive silver halide element.

When using a low molecular weight polysaccharide mixed with dextran in a silver halide emulsion layer, it is advisable to use a lower amount of hardener, to allow the optimum swelling of the layer in the processing baths. In this way a high speed/Dmin ratio can be obtained as disclosed in EP 1,300,724, filed on Sep. 17, 2002. A significant drawback of this technique is that the swollen layer has to be further hardened in the processing chemicals, in order to avoid collapsing of developed silver coils during drying, bringing to lower Dmax as a consequence. For this reason the coating formulation described above is more suitable for materials which are processed in processing chemistries containing a hardener (typically glutaraldehyde or similar).

The present invention made clear that if the advantages of the coating formulation have to be achieved in materials which undergo completely hardener-free processing, for the sake of extending the use of the material universally, not only silver halide tabular crystals should have been used, but they also needed to be extremely thin, in order to get acceptable sensitometric properties in all processing conditions and chemistries.

SUMMARY OF THE INVENTION

One aspect of the present invention relates to a silver halide emulsion which comprises silver halide tabular grains showing an average thickness lower than 0.15 $\mu$m, an average diameter of at least 1.20 $\mu$m and an average aspect ratio of at least 8:1 dispersed in a hydrophilic colloid mixture comprising from 10% to 30% by weight of dextran, from 20% to 40% by weight of a hydrogenated polysaccharide having an average molecular weight equal to or lower than 10,000, and from 40% to 60% by weight of gelatin.

In another aspect, the present invention relates to a silver halide photographic element comprising a support, at least one silver halide emulsion layer coated on at least one side of said support, and at least one protective layer coated over said emulsion layer, said emulsion layer comprising the above described silver halide emulsion.

DETAILED DESCRIPTION OF THE INVENTION

Accordingly, in one aspect the present invention relates to a silver halide emulsion which comprises silver halide tabular grains showing an average thickness lower than 0.15

μm, an average diameter of at least 1.20 μm and an average aspect ratio of at least 8:1 dispersed in a hydrophilic colloid mixture comprising from 10% to 30% by weight of dextran, from 20% to 40% by weight of a hydrogenated polysaccharide having an average molecular weight equal to or lower than 10,000, and from 40% to 60% by weight of gelatin.

Silver halide tabular grains contained in the silver halide emulsion of the present invention have an average diameter:thickness ratio (often referred to in the art as aspect ratio) of at least 8:1, preferably 8:1 to 50:1, more preferably 8:1 to 30:1, and most preferably 8:1 to 20:1. Average diameter of the silver halide tabular grains suitable for use in this invention preferably ranges from 1.20 to 5.00 μm, more preferably from 1.40 to 3.00 μm, and most preferably from 1.50 to 2.00 μm. The silver halide tabular grains suitable for use in this invention have a thickness of less than 0.15 μm, more preferably within 0.05 to 0.15 μm. Copending U.S. patent application Ser. No. 10/697,513, filed the same date as this application is incorporated herein by reference for its disclosure of one technique for the formation of high quality tabular grains with those specific parameters.

The silver halide tabular grain dimensions and characteristics described above can be readily ascertained by analytical procedures otherwise well-known to those skilled in the art. The term "diameter" means the diameter of a circle having an area equal to the projected area of the grain. The term "thickness" means the distance between two substantially parallel main planes constituting the silver halide tabular grains. From the measure of diameter and thickness of each grain the diameter:thickness ratio of each grain can be calculated, and the diameter:thickness ratios of all tabular grains can be averaged to obtain their average diameter:thickness ratio. In practice, it is simpler to obtain the average diameter and the average thickness of the tabular grains and to calculate the average diameter:thickness ratio as the ratio of these two averages. Whatever the method used, the obtained values of average diameter:thickness ratio do not greatly differ.

The projected area of silver halide tabular grains in the emulsion of the present invention accounts for at least 50%, preferably at least 80% and more preferably at least 90% of the projected area of all the silver halide grains of the emulsion.

The coefficient of diameter variation COVd of the tabular grains of the emulsion of the present invention is preferably higher than 30%, more preferably within the range of from 31% to 44%, and most preferably from 34% to 41%.

According to a preferred aspect of the present invention, the hydrophilic colloid mixture comprises from 15% to 25% by weight of dextran, from 25% to 35% by weight of a hydrogenated polysaccharide having an average molecular weight equal to or lower than 10,000, and from 45% to 55% by weight of gelatin.

Dextran is the generic name denoting many high molecular weight glucans predominantly composed of alpha-1→6 bonds as derivatized from sucrose by Leuconostoc mesenteroides and other organisms. Dextran is commercially available in a range of average molecular weight of from 3,000 to 500,000. Preferred range of average molecular weight to be used in the practice of the present invention is comprised between 5,000 and 50,000, more preferably from 10,000 to 25,000. Dextran derivatives include (1) carboxyalkyl dextrans (such as carboxymethyl dextran), (2) dialkyl aminoalkyl dextrans (such as diethyl aminoethyl dextran), and (3) amino dextrans.

For the purposes of the present invention, dextran is typically added in an amount of from 5 to 100 grams per mole of silver, preferably in the range of from 10 to 80 grams per mole of silver, more preferably from 20 to 40 grams per mole of silver in the coating composition used to formulate a specific silver halide layer in the photographic element. Such amounts can be expressed in terms of grams per square meter per side of the resulting silver halide radiographic element, wherein the amounts above correspond to an amount of from about 0.1 to 2.0, preferably in the range of from 0.2 to 1.6, more preferably from 0.4 to 0.8 grams per square meter per side, respectively.

Hydrogenated polysaccharides having a recurring unit comprising five or six carbon atoms are preferably used in the present invention. Preferred recurring units include, for example, adonitol, arbitol, xylitol, dulcitol, iditol, mannitol, rabittol, sorbitol, and the like. The average molecular weight of the hydrogenated polysaccharide derivatives used in the present invention is equal to or lower than 10,000, preferably lower than 8,000, and most preferably in the range of from 6,000 to 1,000.

Hydrogenated polysaccharides are commercially available, for example, under the trade designation POLYSORB™, from Roquette, Lille, France. The preparation of hydrogenated polysaccharides usually starts from natural products (like starch, agar, tragacanth gum, xanthan gum, guar gum, and the like) by means of enzymatic processes (to reduce the average molecular weight) and of reducing processes (to saturate the molecule). POLYSORB™ hydrogenated polysaccharides useful in the present invention are listed below together with their respective CAS registration number.

| Commercial Name | CAS Registration Number |
|---|---|
| POLYSORB ™ AN 221-10/80 | 111092-73-0 |
| POLYSORB ™ P | 39317-78-7 |
| POLYSORB ™ RA 1000 | 204866-68-2 |
| POLYSORB ™ SI | 134633-92-4 |
| POLYSORB ™ 05/60 | 153130-95-1 |
| POLYSORB ™ 70/12/12 | 167140-15-0 |
| POLYSORB ™ 10B | 25086-67-3 |
| POLYSORB ™ 15/100 | 134688-45-2 |
| POLYSORB ™ 2 | 60976-39-8 |
| POLYSORB ™ 2–6 | 90955-13-8 |
| POLYSORB ™ 30/100 | 78690-76-3 |
| POLYSORB ™ 4 | 105287-50-1 |
| POLYSORB ™ 40/100 | 78690-77-4 |
| POLYSORB ™ 5 | 138726-47-3 |
| POLYSORB ™ 6 | 125148-17-6 |
| POLYSORB ™ 60/100 | 122525-49-9 |
| POLYSORB ™ 80/55 | 77466-50-3 |
| POLYSORB ™ 9 | 66593-04-2 |

For the purposes of the present invention, the hydrogenated polysaccharides described above are typically added in an amount of from 10 to 100 grams per mole of silver, preferably in the range of from 20 to 80 grams per mole of silver, more preferably from 40 to 60 grams per mole of silver. Such amounts can be expressed in terms of grams per square meter per side of the resulting silver halide radiographic element, wherein the amounts above correspond to an amount of from 0.2 to 2.0, preferably in the range of from 0.4 to 1.6, more preferably from 0.8 to 1.2 grams per square meter per side, respectively.

Gelatin is a hydrophilic colloid derived from animal collagen. Any gelatin made from animal collagen can be used, but gelatin made from pig skin, cow skin or cow bone collagen is preferable. The kind of gelatin is not specifically limited, but several kinds of gelatins, such as, for example, lime-processed gelatin, acid processed gelatin, amino group inactivated gelatin (such as acetylated gelatin, phthaloylated gelatin, malenoylated gelatin, benzoylated gelatin, succinoylated gelatin, methyl urea gelatin, phenylcarbamoylated gelatin, and carboxy modified gelatin), or gelatin derivatives, such as, for example, gelatin derivatives disclosed in JP Patent Publications 38-4854/1962, 39-5514/1964, 40-12237/1965, 42-26345/1967 and 2-13595/1990, U.S. Pat. Nos. 2,525,753, 2,594,293, 2,614,928, 2,763,639, 3,118,766, 3,132,945, 3,186,846 and 3,312,553 and GB Patents 861,414 and 103,189 can be used singly or in combination. Preferably, gelatin derivatives include highly deionized gelatin, acetylated gelatin and phthalated gelatin.

For the purposes of the present invention, gelatin is typically added in an amount of from 30 to 200 grams per mole of silver, preferably in the range of from 50 to 150 grams per mole of silver, more preferably from 60 to 120 grams per mole of silver. Such amounts can be expressed in terms of grams per square meter per side of the resulting silver halide radiographic element, wherein the amounts above correspond to an amount of from about 0.6 to 3.6, preferably in the range of from 0.9 to 2.7, more preferably from 1.1 to 2.2 grams per square meter per side, respectively.

The silver halide emulsion of the present invention can be prepared either directly conducting the formation and growth of silver halide grains into the above described hydrophilic colloid mixture or, preferably, by first conducting the formation and growth of silver halide grains in gelatin and then adding the proper amounts of dextran and hydrogenated saccharide to get the silver halide emulsion of the present invention. In the latter case, the addition of dextran and hydrogenated saccharide can be done at any time before the coating of the silver halide emulsion. The term "any time before the coating" means to specially include at least after the emulsion-making step, before, during or after the chemical and optical sensitization step, or just before coating step. More preferably, the addition of dextran and hydrogenated saccharide is conducted just before the coating step.

Silver halide emulsions according to the present invention can be prepared using conventional methods, including a single-jet method, a double-jet method, or a combination of these methods and can be ripened using, for instance, an ammonia method, a neutralization method, or an acid method. Parameters which may be adjusted to control grain growth include pH, pAg, temperature, shape and size of reaction vessel, and the reaction method (e.g., accelerated or constant flow rate precipitation, interrupted precipitation, ultrafiltration during precipitation, reverse mixing processes and combinations thereof). A silver halide solvent, such as ammonia, thioethers, thioureas, etc., may be used, if desired, for controlling grain size, grain structure, particle size distribution of the grains, and the grain-growth rate. Methods for preparing silver halide emulsions are generally known to those skilled in the art and can be found in references such as Trivelli and Smith, *The Photographic Journal*, Vol. LXXIX, May 1939, pp. 330–338, T. H. James, *The Theory of The Photographic Process*, 4th Edition, Chapter 3, *Chimie et Physique Photographique*, P. Glafkides, Paul Montel (1967), *Photographic Emulsion Chemistry*, G. F. Duffin, The Focal Press (1966), *Making and Coating Photographic Emulsions*, V. L. Zelikman, The Focal Press (1966), in U.S. Pat. Nos. 2,222,264; 2,592,250; 3,650,757; 3,917,485; 3,790,387; 3,716,276; and 3,979,213; *Research Disclosure*, September 1994, Item 36544 "Photographic Silver Halide Emulsions, Preparations, Addenda, Systems and Processing."

In the present invention, commonly employed halogen compositions of the silver halide grains can be used. Typical silver halides include silver chloride, silver bromide, silver iodide, silver chloroiodide, silver bromoiodide, silver chlorobromoiodide and the like. However, silver bromide and silver bromoiodide are preferred silver halide compositions for silver halide tabular grains with silver bromoiodide compositions containing less than 10 mol % silver iodide, preferably less than 5 mol % silver iodide, and more preferably less than 1.5% mol silver iodide. The halogen composition of individual grains may be homogeneous or heterogeneous.

The preparation process of a silver halide emulsion generally comprises a nucleation step, in which silver halide grain seeds are formed, followed by one or more growing steps, in which the grain seeds achieve their final dimension, and a washing step, in which all soluble salts are removed from the final emulsion. A ripening step is usually present between the nucleation and growing step and/or between the growing and the washing steps.

In the preparation of the silver halide emulsion of the present invention, an aqueous solution of a dispersing medium is put in a reaction vessel together with a bromide salt aqueous solution.

The dispersing medium initially present in the reaction vessel can be chosen among those conventionally employed in the silver halide emulsions. Preferred dispersion media include hydrophilic colloids, such as proteins, protein derivatives, cellulose derivatives (e.g. cellulose esters), gelatin (e.g. acid or alkali treated gelatin), gelatin derivatives (e.g. acetylated gelatin, phthalated gelatin and the like), polysaccharides (e.g. dextran), gum arabic, casein and the like. It is also common to employ said hydrophilic colloids in combination with synthetic polymeric binders and peptizers such as acrylamide and methacrylamide polymers, polymers of alkyl and sulfoalkyl acrylates and methacrylates, polyvinyl alcohol and its derivatives, polyvinyl lactams, polyamides, polyamines, polyvinyl acetates, and the like. The bromide salt is typically a water soluble salt of alkaline or alkaline earth metals, such as, for example, sodium bromide, potassium bromide, ammonium bromide, calcium bromide, or magnesium bromide.

The temperature of the reaction vessel content is preferably in the range of from 30° C. to 80° C., more preferably from 40° C. to 70° C. The pH of the starting solution ranges from 2 to 7, preferably from 3 to 6. The pBr of the starting solution ranges from 0 to 2, preferably from 0.5 to 1.5.

During the nucleation step (a), a soluble silver salt aqueous solution (usually a silver nitrate solution) and a soluble bromide salt aqueous solution (usually a sodium or potassium bromide solution) are added by double jet method to the reaction vessel at a constant flow rate ranging from 10 to 40 ml/min, preferably from 15 to 30 ml/min, by maintaining the temperature constant. During the nucleation step, the amount of silver nitrate added is lower than 5% by weight of total silver nitrate. According to the present invention, the term "total silver nitrate" means the amount of silver nitrate employed during the overall emulsion making process, that is, from step (a) to (d).

At the end of the nucleation step, the addition of silver nitrate solution is stopped and the obtained silver halide grain seeds are subjected to the ripening step (b). The silver halide seeds are allowed to ripen at a temperature of from 30° to 80° C., preferably from 50° to 80° C., for a period of time ranging from 1 to 20 minutes, preferably from 5 to 15 minutes, in the presence of a silver halide solvent. The silver halide solvent is chosen amongst any conventionally known silver halide solvents, e.g., thiourea, ammonia, thioether, thiosulfate or thiocyanate. The concentration of the silver halide solvent into the reaction vessel after the addition can range from 0.002 to 0.3N, preferably form 0.02 to 0.2N. According to a preferred embodiment, the silver halide solvent is an ammonia aqueous solution. At the end of the ripening step, the pH of the reaction vessel content is adjusted to a value of from 4.5 to 6.5, preferably at about 6.

After that, the silver halide grain seeds are subjected to a growth step (c) by double jet addition of a silver nitrate aqueous solution and a halide salt aqueous solution at accelerated flow rate, with a linear ramp starting from within 10 to 50 ml/min and rising to within 40 to 120 ml/min. The halide salt aqueous solution added during this step can either comprise bromide ions or a mixture of bromide and iodide ions. The pBr of the reaction vessel content is kept under control at a value of from 1.0 to 2.0, preferably from 1.0 to 1.5. During this growth step (c), the amount of silver nitrate added is from 55 to 90% by weight of the total silver nitrate.

The final step (d) is performed by a double jet addition of silver nitrate and halide salt aqueous solutions at a constant flow rate of from 20 to 70 ml/min. The halide salt aqueous solution added during this step can either comprise bromide ions or a mixture of bromide and iodide ions. During this step, the amount of silver nitrate added is from 10 to 40%, preferably from 25 to 35% by weight of total silver nitrate. During this step, the pBr is kept under control at a value of from 1.0 to 2.0, preferably from 1.0 to 1.5.

If during the growing step and/or the final step, a soluble iodide salt is added together with the bromide salt the amount of the iodide present in the final emulsion ranges from 0.01 to 10% mol, preferably from 0.05 to 5%mol based on the total halide content.

At the end of the final step (d), the tabular grains can optionally be further ripened for a period of time of from 1 to 20 minutes.

At the end of the silver halide grain formation, water soluble salts are removed from the emulsion by procedures known in the art. Suitable washing processes are those wherein the dispersing medium and soluble salts dissolved therein can be removed from the silver halide emulsion on a continuous basis, such as, for example, a combination of dialysis or electrodialysis for the removal of soluble salts or a combination of osmosis or reverse osmosis for the removal of the dispersing medium.

Among the known techniques for removing the dispersing medium and soluble salts while retaining silver halide grains in the remaining dispersion, ultrafiltration is a particularly advantageous washing process. Typically, an ultrafiltration unit comprising membranes of inert, non-ionic polymers is used as a washing process. Since silver halide grains are large in comparison with the dispersing medium and the soluble salts or ions, silver halide grains are retained by the membranes while the dispersing medium and the soluble salts dissolved therein are removed.

Prior to use, silver halide grain emulsions are generally fully dispersed and subjected to any of the known methods for achieving a desired sensitivity. A wide description of methods and compounds useful in chemical and optical sensitization can be found in Research Disclosure No. 38597, September 1996, "Photographic Silver Halide Emulsions, Preparations, Addenda, Systems and Processing", Items IV and 5.

Chemical sensitization is performed by adding chemical sensitizers and other additional compounds to the silver halide emulsion, followed by the so-called chemical ripening at high temperature for a predetermined period of time. Chemical sensitization can be performed by various chemical sensitizers such as gold, sulfur, reducing agents, platinum, selenium, sulfur plus gold, and the like. Silver halide tabular grains, after grain formation and desalting, are preferably chemically sensitized by at least one gold sensitizer and at least one sulfur sensitizer. During chemical sensitization other compounds can be added to improve the photographic performances of the resulting silver halide emulsion, such as, for example, antifoggants, stabilizers, optical sensitizers, supersensitizers, and the like.

Gold sensitization is performed by adding a gold sensitizer to the emulsion and stirring the emulsion at high temperature of preferably 40° C. or more for a predetermined period of time. As a gold sensitizer, any gold compound which has an oxidation number of +1 or +3 and is normally used as gold sensitizer can be used. Preferred examples of gold sensitizers are chloroauric acid, the salts thereof and gold complexes, such as those described in U.S. Pat. No. 2,399,083. Specific examples of gold sensitizers include chloroauric acid, potassium chloroaurate, auric trichloride, sodium aurithiosulfate, potassium aurithiocyanate, potassium iodoaurate, tetracyanoauric acid, 2-aurosulfobenzothiazole methochloride and ammonium aurothiocyanate.

Sulfur sensitization is performed by adding a sulfur sensitizer to the silver halide emulsion and stirring the emulsion at a high temperature of 40° C. or more for a predetermined period of time. Useful examples of sulfur sensitizer include thiosulfonates, thiocyanates, sulfinates, thioethers, and elemental sulfur.

The amounts of the gold sensitizer and the sulfur sensitizer change in accordance with the various conditions, such as activity of the gold and sulfur sensitizer, type and size of silver halide grains, temperature, pH and time of chemical ripening. These amounts, however, are preferably from 1 to 20 mg of gold sensitizer per mole of silver, and from 1 to 100 mg of sulfur sensitizer per mole of silver. The temperature of chemical ripening is preferably 45° C. or more, and more preferably 50° C. to 80° C. The pAg and pH may take arbitrary values.

During chemical sensitization, addition times and order of gold sensitizer and sulfur sensitizer are not particularly limited. For example, gold and sulfur sensitizers can be added at the initial stage of chemical sensitization or at a later stage either simultaneously or at different times. Usually, gold and sulfur sensitizers are added to the silver halide emulsion by their solutions in water, in a water-miscible organic solvent, such as methanol, ethanol and acetone, or as a mixture thereof.

A stabilizer is preferably added at any time before the addition of the sulfur sensitizer. While not intending to be bound by any particular theory, it is believed that it acts as a digest stabilizer and a site director for the sulfur sensitizer. Preferably, the stabilizer is added before the addition of sulfur chemical sensitizer in an amount of from 1 to 500 milligrams per mole of silver, preferably, from 10 to 300 milligrams per mole of silver.

Specific examples of useful stabilizers include thiazole derivatives; benzothiazole derivatives; mercapto-substituted heterocyclic compounds (e.g., mercaptotetrazoles, mercaptotriazoles, mercaptodiazoles, mercaptopyrimidines, mercaptoazoles); azaindenes, (e.g., triazaindenes and tetrazaindenes); triazoles; tetrazoles; and sulfonic and sulfinic benzene derivatives. Azaindenes are preferably used, more preferably, tetraazaindenes.

A silver halide grain emulsion may be optically sensitized to a desired region of the visible spectrum. Suitable methods for spectral sensitization are known. For example, optical sensitization may be achieved by using an optical sensitizer, such as a cyanine dye, a merocyanine dye, complex cyanine and a merocyanine dye, an oxonol dye, a hemioxonol dye, a styryl dye and a streptocyanine dye, or a combination thereof. Useful optical sensitizers include cyanines derived from quinoline, pyridine, isoquinoline, benzindole, oxazole, thiazole, selenazole, imidazole. Particularly useful optical sensitizers are the dyes of the benzoxazole-, benzimidazole- and benzothiazole-carbocyanine type. Typically, the addition of the spectral sensitizer is performed after the completion of chemical sensitization. Alternatively, spectral sensitization can be performed concurrently with chemical sensitization, before chemical sensitization, or even prior to the completion of silver halide precipitation. When the spectral sensitization is performed before the chemical sensitization, it is believed that the preferential absorption of spectral sensitizing dyes on the crystallographic faces of the tabular grains allows chemical sensitization to occur selectively at unlike crystallographic surfaces of the tabular grains. In a preferred embodiment, the spectral sensitizers produce J aggregates, if adsorbed on the surface of the silver halide grains, and a sharp absorption band (J-band) with a bathochromic shift with respect to the absorption maximum of the free dye in aqueous solution.

It is known in the art of radiographic photographic elements that the intensity of the sharp absorption band (J-band) shown by the spectral sensitizing dye absorbed on the surface of the light-sensitive silver halide grains will vary with the quantity of the specific dye chosen as well as the size and chemical composition of the grains. The maximum intensity of J-band has been obtained with silver halide grains having the above described sizes and the chemical compositions absorbed with J-band spectral sensitizing dyes in a concentration of from 25 to 100 percent or more of monolayer coverage of the total available surface area of the silver halide grains. Optimum dye concentration levels can be chosen in the range of 0.5 to 20 millimoles per mole of silver halide, preferably, in the range of 2 to 10 millimoles.

Spectral sensitizing dyes producing J aggregates are known in the art, such as described by F. M. Hamer, *Cyanine Dyes and Related Compounds*, John Wiley and Sons, 1964, Chapter XVII and by T. H. James, *The Theory of the Photographic Process*, 4th Edition, MacMillan, 1977, Chapter 8.

In a preferred form, J-band exhibiting dyes are cyanine dyes. Such dyes comprise two basic heterocyclic nuclei joined by a linkage of methine groups. The heterocyclic nuclei preferably include fused benzene rings to enhance J aggregation. The heterocyclic nuclei are preferably quinolinium, benzoxazolium, benzothiazolium, benzoselenazolium, benzimidazolium, naphthoxazolium, naphthothiazolium and naphthoselenazolium quaternary salts.

Suitable cyanine dyes, which are joined by a methine linkage, include two basic heterocyclic nuclei, such as pyrrolidine, oxazoline, thiazoline, pyrrole, oxazole, thiazole, selenazole, tetrazole and pyridine and nuclei obtained by fusing an alicyclic hydrocarbon ring or an aromatic hydrocarbon ring to each of the above nuclei, such as indolenine, benzindolenine, indole, benzoxazole, naphthoxazole, benzothiazole, naphthothiazole, benzoselenazole, benzimidazole and quinoline. These nuclei can have substituent groups.

Suitable merocyanine dyes, which are joined by a methine linkage, include a basic heterocyclic nucleus of the type described above and an acid nucleus, such as a 5- or 6-membered heterocyclic nucleus derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1-3-dione, and isoquinolin-4-one.

The methine spectral sensitizing dyes are generally known in the art, such as those described in U.S. Pat. Nos. 2,503,776; 2,912,329; 3,148,187; 3,397,060; 3,573,916; and 3,822,136 and FR Pat. No. 1,118,778. Also their use in photographic emulsions is known, wherein they are used in optimum concentrations corresponding to desired values of sensitivity to fog ratios. Optimum or near optimum concentrations of spectral sensitizing dyes generally go from 10 to 500 mg per mole of silver, preferably, from 50 to 200, and more preferably, from 50 to 100.

Spectral sensitizing dyes can be used in combinations which result in supersensitization, i.e., spectral sensitization which is greater in a spectral region than that from any concentration of one dye alone or which would result from an additive effect of the dyes. Supersensitization can be obtained with selected combinations of spectral sensitizing dyes and other addenda, such as stabilizers and antifoggants, development accelerators and inhibitors, optical brighteners, surfactants and antistatic agents, as described by Gilman, *Photographic Science and Engineering*, 18, pp. 418–430, 1974 and in U.S. Pat. Nos. 2,933,390; 3,635,721; 3,743,510; 3,615,613; 3,615,641; 3,617,295; and 3,635,721.

Other additives can be added to the silver halide emulsion before or during coating, such as, stabilizers or antifoggants (i.e., azaindenes, triazoles, tetrazoles, imidazolium salts, polyhydroxy compounds and others); developing promoters (e.g., benzyl alcohol, polyoxyethylene type compounds, etc.); image stabilizers (i.e., compounds of the chromane, cumaran, bisphenol type, etc.); and lubricants (i.e., wax, higher fatty acids glycerides, higher alcohol esters of higher fatty acids, etc.). Also, coating aids, modifiers of the permeability in the processing liquids, defoaming agents, antistatic agents and matting agents may be used. Other useful additives are disclosed in *Research Disclosure*, Item 17643, December 1978 in *Research Disclosure*, Item 18431, August 1979, in *Research Disclosure*, Item 308119, Section IV, December 1989, and in *Research Disclosure* Item 36544, September 1994.

The silver halide emulsion is then coated on a support to form the photographic element of the present invention. Suitable supports include glass, paper, polyethylene-coated paper, metals, polymeric film such as cellulose nitrate, cellulose acetate, polystyrene, polyethylene terephthalate, polyethylene, polypropylene and the like. A preferred support is polyethylene terephthalate.

Preferred light-sensitive silver halide photographic elements are radiographic light-sensitive elements employed in X-ray imaging comprising a silver halide emulsion layer(s) coated on both surfaces of a support. The silver halide emulsions are preferably coated on the support at a silver coverage in the range of 1.5 to 3 $g/m^2$ per side, more preferably of from 1.5 to 2.5 $g/m^2$ per side.

Usually, the radiographic light-sensitive elements are associated with intensifying screens so as to be exposed to radiation emitted by the screens. Preferable intensifying screens are made of relatively thick phosphor layers which transform the X-rays into more imaging-effective radiation such as light (e.g., visible light and ultraviolet light). In operation, the screens absorb a larger portion of X-rays than the light-sensitive elements do and are used to reduce the X-ray dose necessary to obtain a useful image. Intensifying screens absorbing more than 25% of the total X-radiation are preferably used. Depending on their chemical composition, the phosphors can emit radiation in the ultraviolet, blue, green or red region of the visible spectrum and the silver halide emulsions are sensitized to the wavelength region of the radiation emitted by the screens. Sensitization is performed by using spectral sensitizing dyes absorbed on the surface of the silver halide grains as described above.

Photographic elements of the present invention can include other layers and additives such as subbing layers, surfactants, filter dyes, intermediate layers, protective layers, anti-halation layers, barrier layers, dye underlayers, development inhibiting compounds, speed-increasing agents, stabilizers, plasticizers, chemical sensitizers, UV absorbers and the like. Dye underlayers are particularly useful to reduce the cross-over of the double coated silver halide photographic element. Reference to well-known dye underlayer can be found in U.S. Pat. Nos. 4,900,652; 4,855,221; 4,857,446; and 4,803,150. In a preferred embodiment, a dye underlayer is coated on at least one side of the support, more preferably, on both sides of the support, before the coating of at least two silver halide emulsion.

The silver halide photographic elements of the present invention are preferably forehardened. Typical examples of organic or inorganic hardeners include chrome salts (e.g., chrome alum, chromium acetate), aldehydes (e.g., formaldehyde and glutaraldehyde), carbamoyl pyridinium compounds (1-(N,N-Diethyl carbamoyl)-4-(2-sulfoethyl) pyridine), isocyanate compounds (hexamethylene diisocyanate), active halogen compounds (e.g., 2,4-dichloro-6-hydroxy-s-triazine), epoxy compounds (e.g., tetramethylene glycol diglycidylether), N-methylol derivatives (e.g., dimethylolurea, methyloldimethyl hydantoin), aziridines, mucohalogeno acids (e.g., mucochloric acid), active vinyl derivatives (e.g., vinylsulfonyl and hydroxy-substituted vinylsulfonyl derivatives) and the like. Other references to well known hardeners can be found in *Research Disclosure*, December 1989, Vol. 308, Item 308119, Section X, and *Research Disclosure*, September 1994, Vol. 365, Item 36544, Section 11(b). The more useful hardeners have a quick action and migrate easily through the several layers of the photographic element during its coating. The hardener can be added to any layer of the photographic element of the present invention. The hardener is preferably added to the protective layer in an amount effective to fore-harden the resulting photographic element. Typical amounts of hardener added to the photographic element of the present invention are in the range of from 10 to 100 mg/m$^2$, the specific and preferred amounts also depending on the chemical nature of the hardener.

A detailed description of photographic elements and of various layers and additives can be found in *Research Disclosure* 17643 December 1978, *Research Disclosure* 18431 August 1979, *Research Disclosure* 18716 November 1979, *Research Disclosure* 22534 January 1983, *Research Disclosure* 308119 December 1989, and *Research Disclosure* 36544, September, 1994. The present invention will be now described in greater detail with reference to the following but not limiting examples. Various modifications and alterations of this invention will become apparent to those skilled in the art without departing from the scope and spirit of this invention. It should be understood that this invention is not to be unduly limited to the illustrative embodiments set forth herein.

All the amounts referred to in the following examples are relative to one mole of silver in the resulting silver halide emulsion, unless differently specified. All amounts are referred to one side.

EXAMPLES

Five silver bromide emulsions were prepared using a double jet method. All emulsions contained one mole of silver. The emulsions were chemically and spectrally sensitized using conventional sulfur, gold, and palladium sensitizers plus a triethyl ammonium salt of 5,5'-dichloro-9-ethyl-3,3'-di-(3-sulfopropyl) oxacarbocyanine as spectral sensitization dye. The digest was performed for about 120 to 150 minutes at 60° C. The emulsions were successively stabilized with 200 mg of potassium iodide and 1366 mg of 5-methyl-7-hydroxy-2-3-4-triazoindolizine (4-hydroxy-6-methyl-1,3,3a,7-tetraazaindene) before chilling and kept in cold storage until needed for coating. The following Table 1 summarizes the grain characteristics and gelatin content of the resulting emulsions at the end of sensitization step.

TABLE 1

| Emulsion | Average Diameter | Average Thickness | COVd | Gelatin (g) |
|---|---|---|---|---|
| A | 1.20 | 0.22 | 40 | 58.0 |
| B | 1.80 | 0.11 | 37 | 67.0 |
| C | 1.80 | 0.11 | 37 | 67.0 |
| D | 1.80 | 0.11 | 37 | 67.0 |
| E | 1.80 | 0.11 | 37 | 67.0 |

The sensitized silver bromide emulsions were melted at 45° C. and subjected to coating finals. As coating auxiliaries were added 1.37 g of calcium nitrate, 50 mg of azodicarboxylic dimorpholide, 19.87 g of polyethylacrylate (in dispersion at 30% in water), 260 mg of Colanyl blue and 53 mg of Flexonyl violet as chromatic correctors, the amount of gelatin reported in Table 2, the amount of dextran (CAS No. 9004-54-0) reported in Table 2, and the amount of hydrogenated polysaccharide commercially available under the trade designation POLYSORB™ 70/12/12 (CAS No. 167140-15-0), from Roquette Frères, Lille, France reported in Table 2. Finally, the pH was corrected to 6.5.

The resulting silver bromide emulsions A to E were immediately coated on the two sides of blue 7 mil polyester base with a conventional antistatic protective layer to give radiographic films 1 to 5. The protective layer was based on gelatin (1.19 g/m$^2$) and contained surfactants (11 mg/m$^2$ of Niaproof, the trade name of an anionic surfactant of the alkane sulfate type, 42 mg/m$^2$ of ZONYL™ FSN100, the trade name of a non-ionic perfluoroalkylpolyoxyethylene surfactant, and 12 mg/M$^2$ of lauric acid diethanolamide), matting agents (75 mg/m$^2$ of polymethylmethacrylate particles), and an amount of hardening agent (1,3-bisvinylsulfonyl-2-propanol) as reported in Table 2. The resulting covering weight was adjusted around about two grams of silver per square meter.

TABLE 2

| Film | Emulsion | POLYSORB ™ (g) | Dextran (g) | Gelatin (g) | Hardener (mg/m$^2$) |
|---|---|---|---|---|---|
| 1 (C) | A | 57.3 | 36.0 | 9.0 | 19 |
| 2 (C) | B | 5.2 | 72.0 | 9.0 | 61 |
| 3 (I) | C | 57.3 | 36.0 | 9.0 | 32 |
| 4 (C) | D | 5.2 | 72.0 | 9.0 | 61 |
| 5 (I) | E | 57.3 | 36.0 | 18.0 | 61 |

The following Table 3 summarizes the percentages of POLYSORB™, dextran and gelatin in the emulsion layer of the resulting radiographic films.

TABLE 3

| Film | POLYSORB ™ % | Dextran % | Gelatin % |
|---|---|---|---|
| 1 (C) | 35.0 | 22.5 | 42.5 |
| 2 (C) | 3.4 | 47.0 | 49.6 |
| 3 (I) | 33.8 | 21.2 | 45.0 |
| 4 (C) | 3.4 | 47.0 | 49.6 |
| 5 (I) | 32.0 | 20.0 | 48.0 |

The fresh film samples were kept 3 days at 38° C. before being subjected to X-ray exposure using an X-ray tube at 70 KVp and 160 Milliampere for 0.1 second with two green emitting screens commercially available under the trade designation LIFERAY™ Medium Screen manufactured by Ferrania S.p.A., Italy.

The exposed films were processed through a 90 second dry to dry process in a automatic processor XP-515 (manufactured by Ferrania S.p.A., Italy) with commercially available processing chemistry (LIFERAY™ XAD-3 developer and LIFEARY™ XAF-3 fixer, both from Ferrania S.p.A., Italy or Kodak RP X-OMAT™ developer and fixer).

The sensitometric results and covering power are reported in the following Table 4, wherein, under the "RP" columns are reported the values obtained by using the above mentioned Kodak RP chemistry, and under the "APS" columns are reported the values obtained by using the above mentioned LifeRay chemistry. The Kodak RP chemistry comprises a hardener, the LIFERAY™ chemistry is hardener-free.

TABLE 4

| | | D.max | | Speed | | Shoulder Contrast | | Covering Power | |
|---|---|---|---|---|---|---|---|---|---|
| Film | D. min | RP | APS | RP | APS | RP | APS | RP | APS |
| 1 (C) | 0.240 | 3.53 | 3.21 | 2.46 | 2.45 | 3.25 | 2.96 | 0.87 | 0.80 |
| 2 (C) | 0.260 | 3.97 | 3.70 | 2.48 | 2.50 | 3.85 | 3.32 | 1.09 | 1.01 |
| 3 (I) | 0.260 | 3.71 | 3.44 | 2.54 | 2.56 | 3.50 | 2.88 | 1.02 | 0.95 |
| 4 (C) | 0.260 | 3.85 | 3.80 | 2.49 | 2.48 | 3.90 | 3.40 | 1.02 | 0.99 |
| 5 (I) | 0.250 | 3.70 | 3.54 | 2.53 | 2.52 | 3.40 | 3.24 | 0.95 | 0.91 |

Comparison radiographic films showed a low speed value (samples 1, 2 and 4), a bad covering power (sample 1), and a strong decrease of maximum density (Dmax) in LIFERAY™ chemistry (sample 1). Radiographic films of the present invention, comprising the thin tabular grains and the coating formulation described above, showed the best results in terms of speed, with a still good covering power and a more limited decrease of Dmax in LIFERAY™ chemistry.

What is claimed is:

1. A silver halide emulsion which comprises silver halide tabular grains showing an average thickness lower than 0.15 μm, an average diameter of at least 1.20 μm and an average aspect ratio of at least 8:1 dispersed in a hydrophilic colloid mixture comprising from 10% to 30% by weight of dextran, from 20% to 40% by weight of a hydrogenated polysaccharide having an average molecular weight equal to or lower than 10,000, and from 40% to 60% by weight of gelatin.

2. The silver halide emulsion of claim 1, characterized in that said hydrophilic colloid mixture comprises from 15% to 25% by weight of said dextran, from 25% to 35% by weight of said hydrogenated polysaccharide, and from 45% to 55% by weight of said gelatin.

3. The silver halide emulsion of claim 1, characterized in that said hydrophilic colloid mixture comprises an amount of said dextran of from 5 to 100 grams per mole of silver, an amount of said hydrogenated polysaccharide of from 10 to 100 grams per mole of silver, and an amount of said gelatin of from 30 to 200 grams per mole of silver.

4. The silver halide emulsion of claim 1, characterized in that said hydrophilic colloid mixture comprises an amount of said dextran of from 10 to 80 grams per mole of silver, an amount of said hydrogenated polysaccharide of from 20 to 80 grams per mole of silver, and an amount of said gelatin of from 50 to 150 grams per mole of silver.

5. The silver halide emulsion of claim 1, characterized in that said hydrophilic colloid mixture comprises an amount of said dextran of from 20 to 40 grams per mole of silver, an amount of said hydrogenated polysaccharide of from 40 to 60 grams per mole of silver, and an amount of said gelatin of from 60 to 120 grams per mole of silver.

6. The silver halide emulsion of claim 1, characterized in that said tabular grains have an average thickness within the range of from 0.05 to 0.15 μm.

7. The silver halide emulsion of claim 1, characterized in that said tabular grains have an average diameter of at least 1.40 μm.

8. The silver halide emulsion of claim 1, characterized in that said tabular grains have an average aspect ratio of from 8:1 to 50:1.

9. A silver halide photographic element comprising a support, at least one silver halide emulsion layer coated on at least one side of said support, and at least one protective layer coated over said emulsion layer, said emulsion layer comprising a silver halide emulsion which comprises silver halide tabular grains showing an average thickness lower than 0.15 μm, an average diameter of at least 1.20 μm and an average aspect ratio of at least 8:1 dispersed in a hydrophilic colloid mixture comprising from 10% to 30% by weight of dextran, from 20% to 40% by weight of a hydrogenated polysaccharide having an average molecular weight equal to or lower than 10,000, and from 40% to 60% by weight of gelatin.

10. The silver halide photographic element of claim 9, characterized in that said hydrophilic colloid mixture comprises from 15% to 25% by weight of said dextran, from 25% to 35% by weight of said hydrogenated polysaccharide, and from 45% to 55% by weight of said gelatin.

11. The silver halide photographic element of claim 9, characterized in that said hydrophilic colloid mixture comprises a dextran amount of from 5 to 100 grams per mole of silver, a hydrogenated polysaccharide amount of from 10 to 100 grams per mole of silver, and a gelatin amount of from 30 to 200 grams per mole of silver.

12. The silver halide photographic element of claim 9, characterized in that said hydrophilic colloid mixture comprises a dextran amount of from 10 to 80 grams per mole of silver, a hydrogenated polysaccharide amount of from 20 to 80 grams per mole of silver, and a gelatin amount of from 50 to 150 grams per mole of silver.

13. The silver halide photographic element of claim 9, characterized in that said hydrophilic colloid mixture comprises a dextran amount of from 20 to 40 grams per mole of silver, a hydrogenated polysaccharide amount of from 40 to 60 grams per mole of silver, and a gelatin amount of from 60 to 120 grams per mole of silver.

14. The silver halide photographic element of claim 9, characterized in that said tabular grains have an average thickness within the range of from 0.05 to 0.15 μm.

15. The silver halide photographic element of claim 9, characterized in that said tabular grains have an average diameter of at least 1.40 μm.

16. The silver halide photographic element of claim 9, characterized in that said tabular grains have an average aspect ratio of from 8:1 to 50:1.

* * * * *